US005093815A

United States Patent [19]

Rudolph

[11] Patent Number: 5,093,815

[45] Date of Patent: Mar. 3, 1992

[54] HOURGLASS NOVELTY APPARATUS HAVING UNEQUAL CHAMBER VOLUMES

[76] Inventor: James R. Rudolph, 340 Lewis Rd., New Britain, Conn. 06053

[21] Appl. No.: 512,355

[22] Filed: Apr. 23, 1990

[51] Int. Cl.[5] ..... G04F 01/04

[52] U.S. Cl. ..... 368/93; 368/95

[58] Field of Search ..... 368/90-95

[56] References Cited

U.S. PATENT DOCUMENTS 2,144,857 1/1939 Schultz ..... 368/93

4,527,905 7/1985 Kohis ..... 368/93

*Primary Examiner*—Bernard Roskoski

*Attorney, Agent, or Firm*—Robert S. Smith

[57] ABSTRACT

Apparatus for measuring time which comprises a first chamber and a second chamber. The second chamber is bigger than the first chamber. The structure includes apparatus for mounting the first and second chambers in generally aligned relationship and for coupling the first and second chambers to allow passage of a fluent particulate material between the first and second chambers. A quantity of fluent particulate matter having a volume substantially equal to the second chamber is disposed within the volume of the first chamber, the second chamber and the apparatus for coupling.

2 Claims, 1 Drawing Sheet

HOURGLASS NOVELTY APPARATUS HAVING UNEQUAL CHAMBER VOLUMES

BACKGROUND OF THE INVENTION

The invention relates to hourglass apparatus for measuring time and particularly to novelty apparatus intended to amuse.

The prior art includes apparatus such as that described in U.S. Pat. No. 4,527,905 which shows an hourglass having first and second upper chambers and first and second lower chambers. The apparatus is intended to sequentially measure first and second sequentially performed steps as in the game Trivial Pursuit.

While such apparatus is particulary suitable for that application, does not satisfy the continuing requirement of the marketplace for novelty apparatus.

It is an object to the invention to provide apparatus which will have the appearance of being a conventional hourglass apparatus but which will in reality function in a very different manner.

It is an object of the invention to provide apparatus which is novel and which will be accepted in the marketplace.

It is another object of the invention to provide apparatus which is simple and inexpensive to manufacture.

SUMMARY OF THE INVENTION

It has now been found that these and other objects of the invention may be attained in apparatus for measuring time which comprises a first chamber, a second chamber that is larger than the first and means for mounting the first and second chambers in generally aligned relationship and means for coupling the first and second chambers to allow passage of a fluent particulate material between the first and second chambers. The means for coupling includes a passageway limiting the flow rate of fluent particulate material between the chambers, the apparatus also including a quantity of fluent particulate matter having a volume substantially equal to the second chamber disposed within the volume of the first chamber, the second chamber and the means for coupling.

The first and second chambers may be cylindrical and coaxial. The chambers may have a uniform diameter over substantially the entire axial extent thereof. The first and second chambers may be respective axial sections of a single elongated tube and may be separated by a throat section of reduced diameter. The tube may have respective first and second axial extremities which may be disposed as the axial extremities of the first and second chambers. First and second bases for supporting the apparatus may be disposed respectively at the first and second axial extremities. The bases may each be dimensioned and configured for supporting the apparatus with the axis of the chambers disposed in substantially vertical orientation. The second base may have a recess therein for engaging the axial extremity of the second chamber and the first base may have a recess therein for engaging the axial extremity of the first chamber. The second base may engage a greater axial extent of the second chamber than the axial extent of the first chamber that is engaged by the first base.

The axial extent of the first chamber not engaged with the first base may be substantially equal to the axial extent of the second chamber which does not engage the second base. The first base may be dimensioned and configured for engaging the first chamber and supporting the apparatus with the second chamber substantially directly above the first chamber and the second base being dimensioned and configured for engaging the second chamber and supporting the apparatus with the first chamber substantially above the second chamber. The second base may engage a greater extend of the second chamber than the first base engages the first chamber. Each of the first and second bases may have a face thereof into which respectively the first and second chambers may be respectively engaged. The distance between (1) the means for coupling and the face of the first base and (2) the distance between the face in the second base and the means for coupling may be substantially equal.

BRIEF DESCRIPTION OF THE DRAWING

The invention will be better understood by reference to the accompanying drawing in which.

DESCRIPTION OF THE PREFERRED EMBODIMENT

Figure 1:
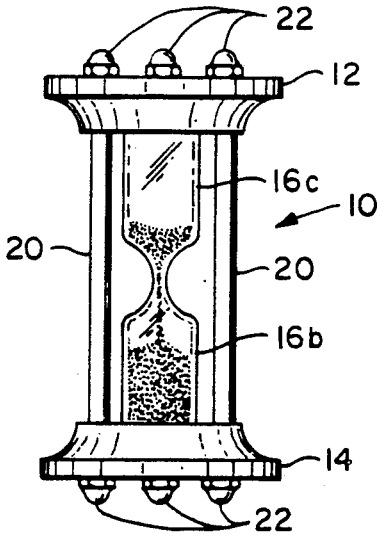
FIG. 1 is a front elevation view of the hourglass apparatus in accordance with one form of the present invention.
Figure 2:
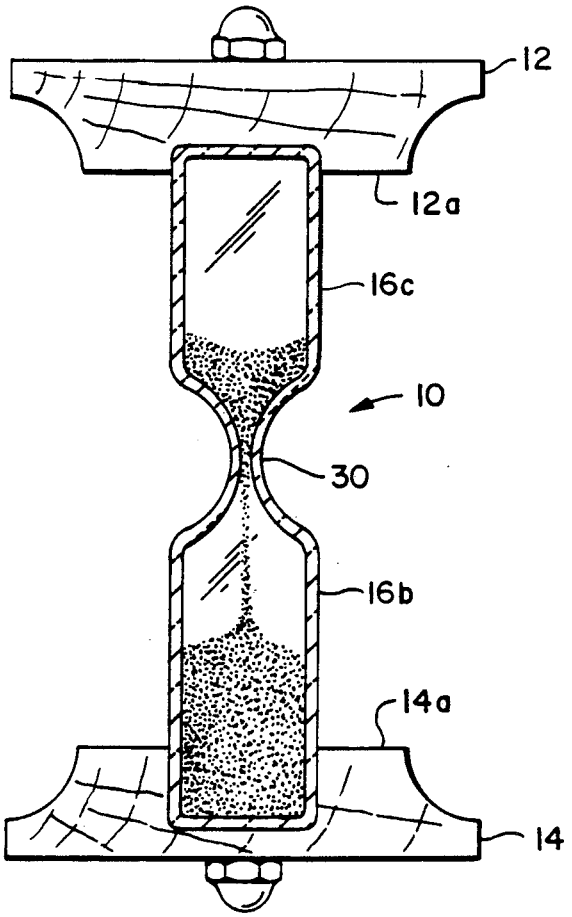
FIG. 2 is a simplified front elevational view in partial section showing the apparatus in FIG. 1 in greater detail and showing the fluent material passing through the neck portion.
Figure 3:
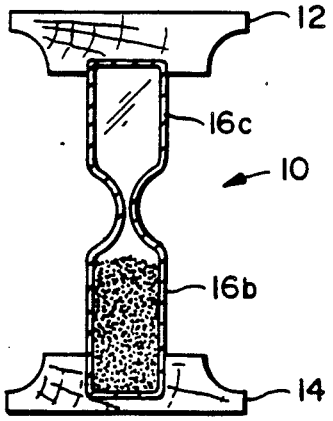
FIG. 3 is a view similar to FIG. 2 showing all of the fluent material in the lower chamber.
Figure 4:
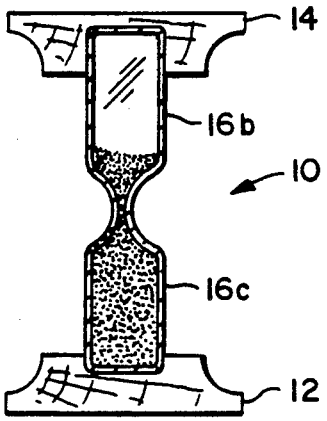
FIG. 4 is a view similar to FIG. 3 in which the apparatus has been inverted and which shows that not all the fluent material will fit into the other chamber.

Referring now to FIGS. 1, 2 and 3 there is shown an hourglass 10 in accordance with one form of the invention which includesd first and second bases 12,14 and an elongated tube 16 having a conventional neck portion 16*a* and a first chamber 16*b* and a second chamber 16*c*. The chambers 16*b* and 16*c* in the apparatus of the present invention are of unequal size. More specifically, the chamber 16*b* is larger than the chamber 16*c*. The larger chamber 16*b* is disposed in recess in the base 14 which is larger than the corresponding recess in the base 14 receiving the chamber 16*c*. Because of the difference in sizes of the recesses in the bases 12, 14 an illusion, as best shown in FIG. 1 is created that the two chambers 16*b* and 16*c* are equal in size.

Ordinarily, one of the two chambers 16*b*, 16*c* is sealed by a glassblower at the same time that the next chamber 16*a* is formed.

The apparatus also includes three rods 20 (two shown) joining the first and second bases 12,14. The rods 20,20, are secured by means of threaded nuts 22 at each axial extremity thereof.

Ordinarily, the end of the tube 16 which is sealed by heating in a conventional glassblowing glass blowing technique is opposite the other axial extremity of the tube 16 which will be sealed by a silicone material which is deposited around the opening thereof.

Ordinarily the bases 12,14 will be manufactured of wood, although other material such a plastic or metal are equally suitable. The tube 16 will ordinarily be of glass, although it may be of other transparent material such as some plastics. The particulate matter disposed within the tube will ordinarily be sand, although other particulate material may be used.

It will thus be seen that the bases 12,14 has a face 12*a*, 14*a* thereof into which respectively the chambers 16*c*, 16*b* are respectively engaged. The distance between (1) the means for fluid coupling 30 and the face 12*a* of the first base 12 and (2) the distance between the face 14*a* in the second base 14 and the means for fluid coupling 30 is substantially equal. It will be understood that in alternative embodiments of the invention both of the chambers 16*b* and 16*c* will still appear to be of equal volume. In such embodiments the illusion may be created variations in diameter of respective chambers or by providing a dimple in the end of one chamber in the manner of many champagne bottles. In other embodiments this illusion may be achieved by providing an inner tube or a rod in one chamber to occupy space and produce substantially the same effect.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the appended claims.

Having thus described my invention I claim:

1. Apparatus for measuring time which comprises:

means for containing a fluid particulate material comprising a first chamber and a second chamber, said second chamber being bigger than said first chamber, said first and second chambers being cylindrical and coaxial and having a uniform diameter over substantially the entire axial extent thereof, said first and second chambers being respective axial sections of a single elongated tube and said first and second chambers are separated by a throat section of reduced diameter, and tube having respective first and second axial extremities disposed as the axial extremities of said first and second chambers;

means for mounting said first and second chambers in generally aligned relationship;

means for coupling said first and second chambers to allow passage of a fluent particulate material between said first and second chambers, said means for coupling consisting of only a single fixed passageway between said first and second chambers, said apparatus having no other fluid;

a quantity of fluent particulate matter having a volume substantially no greater than said second chamber disposed within said first chamber, said second chamber and said means for coupling, said quantity having a volume greater than the volume of said first chamber; and first and second bases for supporting said apparatus disposed respectively at said first and second axial extremities, said bases each being dimensioned and configured for supporting said apparatus with the axis of said chambers disposed in substantially vertical orientation; said second base has a recess therein for engaging the axial extremity of said second chamber and said first base has a recess therein for engaging the aixal extremity of said first chamber, said second base engaging a greater axial extent of said second chamber than said first base engages said first chamber; the axial extent of said first chamber not engaged with said first base being substantially equal to the axial extent of said second chamber not engaged by said second base.

2. Apparatus for measuring time which comprises:

means for containing a fluid particulate material comprising a first chamber and a second chamber, said second chamber being bigger than said first chamber, said first and second chambers having a substantially uniform cross-section over substantially the entire axial extent thereof, said first and second chambers being respective axial sections of a single elongated tube and said first and second chambers are separated by a throat section of reduced diameter, said tube having respective first and second axial extremities disposed as the axial extremities of said first and second chambers;

means for mounting said first and second chambers in generally aligned relationship;

means for coupling said first and second chambers to allow passage of a fluent particulate material between said first and second chambers, said means for coupling consisting of only a single fixed passageway between said first and second chambers, said apparatus having no other fluid;

a quantity of fluent particulate matter having a volume substantially no greater than said second chamber disposed within said first chamber, said second chamber and said means for coupling, said quantity having a volume greater than the volume of said first chamber; and first and second bases for supporting said apparatus disposed respectively at said first and second axial extremities, said bases each being dimensioned and configured for supporting said apparatus with the axis of said chambers disposed in substantially vertical orientation; said second base has a recess therein for engaging the axial extremity of said second chamber and said first base has a recess therein for engaging the axial extremity of said first chamber, said second base engaging a greater axial extent of said second chamber than said first base engages said first chamber; the axial extent of said first chamber not engaged with said first base being substantially equal to the axial extent of said second chamber not engaged by said second base.

* * * * *